United States Patent [19]

Horseling

[11] 4,310,778

[45] Jan. 12, 1982

[54] TELEVISION CAMERA TUBE WITH ANTIHALO PLATE

[75] Inventor: Jan Horseling, Eindhoven, Netherlands

[73] Assignee: U.S. Philips Corporation, New York, N.Y.

[21] Appl. No.: 147,894

[22] Filed: May 8, 1980

[30] Foreign Application Priority Data

Jun. 19, 1979 [NL] Netherlands ..... 7904754

[51] Int. Cl.[3] ..... H01J 29/89; H01J 31/26

[52] U.S. Cl. ..... 313/371; 313/384; 313/478

[58] Field of Search ..... 313/371, 384, 478, 474, 313/388

[56] References Cited

U.S. PATENT DOCUMENTS

| | | | |
|---|---|---|---|
| 2,312,206 | 2/1943 | Calbick | 313/478 X |
| 4,080,547 | 3/1978 | Kohzai | 313/371 |
| 4,251,748 | 2/1981 | van Tongeren et al. | 313/371 |
| 4,253,039 | 2/1981 | Fujita et al. | 313/371 |

FOREIGN PATENT DOCUMENTS

| | | | |
|---|---|---|---|
| 43-24845 | 10/1968 | Japan | 313/384 |

*Primary Examiner*—Palmer C. Demeo

*Attorney, Agent, or Firm*—Thomas A. Briody; David R. Treacy; Robert J. Kraus

[57] ABSTRACT

In a television camera tube flare is reduced without introducing vignetting by using an antihalo plate. A contact surface of the plate with the tube's window is slightly larger than a frame which is described by the tube's electron beam on a photoconductive target inside the window. An entrance face of the plate has a diagonal or diameter which is slightly larger than the contact surface.

5 Claims, 6 Drawing Figures

2/2

TELEVISION CAMERA TUBE WITH ANTIHALO PLATE

BACKGROUND OF THE INVENTION

The invention relates to a television camera tube comprising in one end of an evacuated tubular envelope an electron gun to generate an electron beam, which electron beam is deflected so that it describes a frame on a photoconductive target, which target is provided on or near the inside of a window closing the other end of the envelope, against the outside of which window an antihalo plate is provided the circular surface of which has a reduced light reflexion.

Examples of such tubes are vidicon tubes, Plumbicon (Registered Trade Mark) tubes, SEC tubes and tubes having a hetero junction layer, for example, Zn-Cd-Te. The target in such tubes usually consists of a transparent signal electrode which is provided on the window and on which a photoconductive layer is provided. The operation of such tubes is as follows. The signal electrode is connected to a voltage source via a signal resistor. The potential of the signal electrode is positive relative to the potential of the cathode of the electron gun which is at zero volts. The scene to be picked up is projected onto the photoconductive layer through the transparent signal electrode. The side of the photoconductive layer facing the electron gun may be considered as being composed of a large number of picture elements. Under the influence of the positive potential of the signal electrode the potential of said picture elements locally increases as a result of photoconduction of the photoconductive layer. Thus the potential of the picture elements depends on the incident light intensity. As a result of this a potential picture is formed on the side of the photoconductive layer facing the electron gun. Since the electron beam is deflected and describes a frame on the target, the potential of the picture elements is reduced periodically to the potential of the cathode. The current associated therewith flows via the signal electrode which all picture elements have in common, through the signal resistor as a result of which a voltage is formed across said signal resistor. This voltage represents, as a function of time, the light intensity of the optical image as a function of the place on the photoconductive layer. In such tubes a target is usually used which covers substantially the whole window.

In such a television camera tube which is disclosed in Netherlands Patent Application No. 7603829 (PHN 8357) laid open to public inspection, a phenomenon referred to as "flare" often occurs, which disturbs the picture and which is caused by overexposure of specific parts of the target by stray light. This stray light is formed by internal reflections both in front of and behind the target. Flare can be reduced inter alia by means of the antihalo plate which is provided against the outside of the window immediately in front of the target. Additionally the antihalo plate ensures that dust particles which would otherwise become visible when the lens of the camera has a small aperture cannot come in the focal plane. In Netherlands Patent Application No. 7603829 laid open to public inspection it is described that the peripheral surface of the antihalo plate consists of a non-reflective material and thus partly suppresses the undesired reflections. However, this measure proves to be insufficient. Of the light which passes through the camera lens and the antihalo plate onto the target a part is absorbed and produces the photosignal, another part is passed through, and a further part is reflected by the target. In the case of red light, the passed and reflected light causes strong flare so that discolouring of the picture over the whole surface may result. For red light the ratio of absorbed-passed-reflected light is approximately 1:1:1. The flare caused by the light passed through the target is controlled effectively in known manner by blackening the mesh which, viewed from the antihalo plate, is present immediately behind the target. However, the reflected red light still produces problems, in particular in the case of large angles of incidence.

The image produced by the camera lens often extends over the whole surface of the antihalo plate which is much larger than the frame which is described by the electron beam. A mask on the entrance face of the antihalo plate is of little effect and/or gives rise to so-called "vignetting" (this is a strong brightness decline towards the edge of the picture). Vignetting is also produced when a rectangular antihalo plate having slightly larger dimensions than the dimensions of the frame is provided.

SUMMARY OF THE INVENTION

It is the object of the invention to provide a camera tube in which the flare is considerably reduced and vignetting is prevented.

A television camera tube of the kind mentioned in the opening paragraph is characterized according to the invention in that the contact surface of the antihalo plate and the window is smaller than the entrance face of the antihalo plate situated opposite to and parallel to the contact surface, and the frame, viewed through the antihalo plate, falls within the contact surface.

An advantage of the invention is that the antihalo plate may be 2.5 to 3 mm thick instead of the usual 3.5–4 mm.

The surface of the target is illuminated only restrictedly in that a light-absorbing mask formed by the peripheral surface is obtained with reduced reflexion in a very simple manner and as closed as possible in front of the target.

In a television camera tube according to the invention the diagonal or diameter of the contact surface preferably is only a few tenths of a millimeter larger than the diagonal of the frame and the diagonal or diameter of the entrance face is one to a few millimeters larger than the diagonal or diameter of the contact surface.

A second preferred embodiment of the invention is such a television camera tube in which the antihalo plate consists of a circular plane-parallel plate which is approximately equally large as the window and one surface of said plate is ground away partly so that the restricted contact surface is formed.

According to a third preferred embodiment the antihalo plate consists of a plane-parallel plate the edge of which is bevelled on one side at least partly so that the restricted contact surface is formed.

It will be obvious that the restricted contact surface can also be obtained by partly grinding away the edge of the window. However, in practice this has proved to be much less attractive and much more expensive.

BRIEF DESCRIPTION OF THE DRAWING

The invention will now be described in greater detail, by way of example, with reference to a drawing, in which.

DESCRIPTION OF THE PREFERRED EMBODIMENTS

Figure 1:
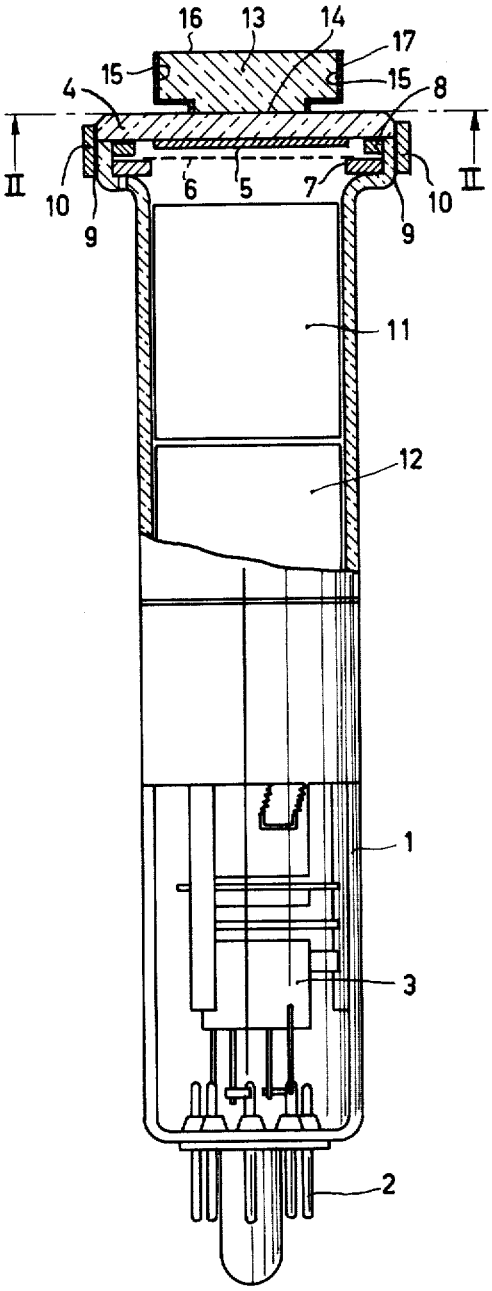
FIG. 1 is a longitudinal sectional view of a television camera tube of the Plumbicon (Registered Trade Mark) type.

FIG. 1 is a longitudinal sectional view of a television camera tube. Such a tube is composed of a tubular glass envelope 1 which at one end comprises a number of connection pins 2 which in the tube are connected to a system of electrodes which together constitute an electron gun 3. The other side of the envelope 1 is sealed by means of a window 4 on the inside of which a target 5 is provided which consists of a signal electrode and a photoconductive layer consisting, for example, of antimony trisulphide or lead oxide, but which may also consist of a piezo-electric material, for example, triglycine sulphate (T.G.S.) as is used in infra-red sensitive tubes. At a short distance before the target a mesh 6 is provided in the tube and is preferably blackened and provided parallel to the target, which mesh is connected to a ring 7. The distance between the mesh and the target is determined by means of ring 8. The window 4 is secured to the envelope 1 by means of an indium seal 9 and a metal ribbon 10. Thinfilm wall electrodes 11 and 12 of nickel are provided on the inner wall of the envelope. The window 4 comprises an antihalo plate 13 and the contact surface 14 has the same shape as but slightly larger dimensions than the frame described on the target 5 by the electron beam. This will be explained in detail with reference to FIG. 5. The peripheral surface 15 of the antihalo plate 13 which is situated between the contact surface 14 and the entrance face 16 is covered with a light-absorbing layer 17 or comprises a light scattering surface formed, for example, by roughening the glass. A very good light-absorbing layer can be obtained by dipping the peripheral surface 15 in a silver-containing bath and then firing in oxygen (so-called staining).

Figure 2:
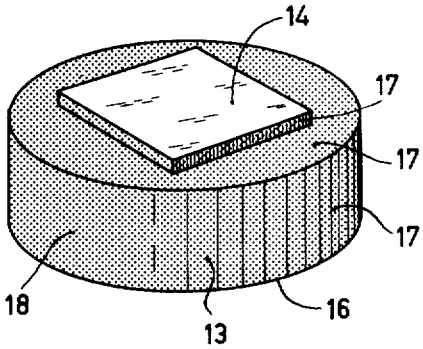
FIG. 2 is a perspective view of the antihalo plate, viewed from the line II—II in FIG. 1

FIG. 2 is a perspective view of the antihalo plate 13 which comprises a disk-shaped part 18 having a diameter of 20 mm and a thickness of 3 mm at the edge. The restricted contact surface 14 which is 14 mm long and 11 mm wide is obtained by grinding away from a 5 mm thick disk a part at the edge of, for example, 1 mm thickness.

Figure 3:
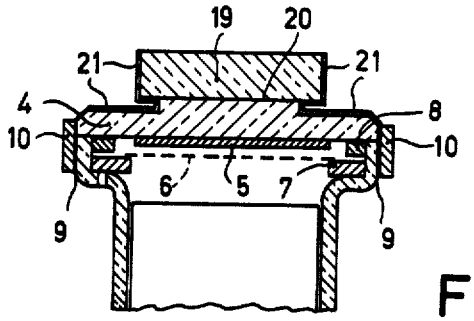
FIG. 3 shows a portion of another embodiment of the television camera tube shown in FIG. 1.

It is also possible, as is shown in FIG. 3, to obtain a restricted contact surface by grinding away a part of the window 4 in an analogous manner. The antihalo plate 19 in this case is a 3 mm thick disk having a diameter of 20 mm. The contact surface 20 also has dimensions of a few tenths of a millimeter larger than the frame described on the target 5. The peripheral surface of the antihalo plate and the window surface up to the contact surface of the antihalo plate are covered with a light-absorbing layer 21 obtained by staining.

Figure 4:
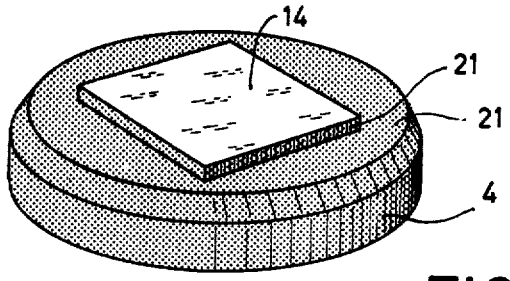
FIG. 4 is a perspective view of the window of the television camera tube shown in FIG. 3.

FIG. 4 is a perspective view of the window 4 shown in FIG. 3.

Figure 5:
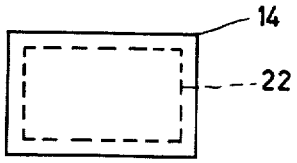
FIG. 5 shows the frame and the contact surface.

FIG. 5 shows the contact surface 14 which overlaps the frame 22 shown on the target 5 with a margin of 0.4 mm. The contact surface is 14 mm long and 11 mm wide and the window is 1.3 mm thick. In the case of thicker windows the margin should be slightly wider, in the case of thinner windows the margin may be slightly narrower.

By using a camera tube in accordance with the invention, the irradiated surface of the target is restricted so that the flare is reduced because fewer reflections occur without vignetting occurring. The reflections which still occur cause flare which often can be compensated for electronically because these reflections are caused within the frame surface. If desired the shape of the antihalo plate may be rectangular. In such a case a diagonal of the contact surface, however, should always be a few tenths of a millimeter larger than the diagonal of the frame and the diagonal of the entrance face should be a few millimeters larger than that of the contact surface.

Figure 6:
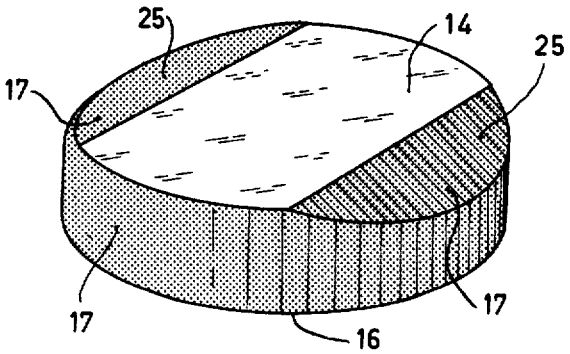
FIG. 6 is a perspective view of another embodiment of an antihalo plate.

The antihalo plate may also be formed as shown in FIG. 6. The restricted contact surface 14 is obtained by partly bevelling the edge 25 of the plate. The peripheral surface 17 (including the bevelled parts) are stained up to the entrance face 16.

What is claimed is:

1. A television camera tube comprising in one end of an evacuated tubular envelope an electron gun for generating an electron beam which, when deflected, describes a frame on a photoconductive target provided at the inside of a window closing the other end of the envelope, the outside of the window having an antihalo plate provided thereon, said plate including a peripheral surface adapted for reduced light reflection, characterized in that a contact surface of the plate and the window is smaller than an entrance face of the plate situated opposite to and parallel to the contact surface, and the frame, viewed through the plate, falls within the contact surface.

2. A television camera tube as in claim 1, characterized in that the diagonal or diameter of the contact surface is only a few tenths of a millimeter larger than the diagonal of the frame, and the diagonal or diameter of the entrance face is one to a few millimeters larger than the diagonal or diameter of the contact surface.

3. A television camera tube as in claim 1 or 2, characterized in that the antihalo plate comprises a circular plane-parallel plate which is approximately as large as the window and has one surface partly ground away to form the contact surface.

4. A television camera tube as in claim 1, characterized in that the antihalo plate comprises a plane-parallel plate having the edge on one side at least partly bevelled to form the contact surface.

5. A television camera tube as in any of the preceding claims, characterized in that the antihalo plate has a thickness between 2.5 and 3 mm.

* * * * *